US005947286A

United States Patent [19]

Chau

[11] Patent Number: 5,947,286

[45] Date of Patent: Sep. 7, 1999

[54] CARRYING CASE WITH REMOVABLE AND REPLACEABLE INTERIOR PANELS

[75] Inventor: Norman Chau, Kenneth City, Fla.

[73] Assignee: Agora Sales, Inc. d/b/a Agora Leather Products, St. Petersburg, Fla.

[21] Appl. No.: 09/133,616

[22] Filed: Aug. 13, 1998

[51] Int. Cl.[6] ..... B65D 85/28; A45C 3/00

[52] U.S. Cl. ..... 206/372; 190/40; 24/300

[58] Field of Search ..... 206/372; 190/102, 190/109, 110; 24/300, 482

[56] References Cited

U.S. PATENT DOCUMENTS

| | | | |
|---|---|---|---|
| 665,724 | 1/1901 | Beech . | |
| 2,757,022 | 5/1956 | Young | 281/15 |
| 3,306,404 | 2/1967 | Yellin | 190/110 |
| 3,347,346 | 10/1967 | Young | 190/110 |
| 4,569,108 | 2/1986 | Schwab | 24/300 |
| 4,796,735 | 1/1989 | Horiuchi | 190/109 |
| 4,854,432 | 8/1989 | Carpenter et al. | 190/110 |
| 5,115,893 | 5/1992 | Terkildsen | 190/11 |
| 5,186,510 | 2/1993 | Stapp | 190/110 |
| 5,429,235 | 7/1995 | Chen | 206/372 |
| 5,435,045 | 7/1995 | Anscher | 24/482 |

*Primary Examiner*—Paul T. Sewell
*Assistant Examiner*—J. Mohandesi
*Attorney, Agent, or Firm*—Carlton Fields

[57] ABSTRACT

A carrying case with removable and replaceable interior panels is disclosed in which structure is provided in the case for releasably retaining such interior panels in fixed position within the case.

7 Claims, 3 Drawing Sheets

CARRYING CASE WITH REMOVABLE AND REPLACEABLE INTERIOR PANELS

BACKGROUND OF THE INVENTION

This invention relates to carrying cases, and more particularly to carrying cases having removable and replaceable interior panels. This type of carrying case is frequently utilized for carrying tools. This type of case may appear from the outside to be of a configuration generally similar to that of a briefcase, while opening up to reveal an interior having a number of holders or pockets built into the sides of the case for holding various tools and components.

In the past it has been common practice to provide specialized carrying cases having interior holders and pockets for a variety of tools commonly used by service personnel and technicians for servicing a particular type of equipment. These cases generally would have pockets and holders fabricated to hold specific types of wrenches, tools, components and other items commonly needed for the type of work contemplated. However, this has necessitated the provision of customized cases, frequently at substantial expense, which are appealing only to a very limited customer base interested in that specific configuration. When a somewhat similar carrying case was desired for a slightly different purpose, it would be necessary to have a different, custom designed interior for holding the tools and components needed for that other type of activity.

Ultimately, manufacturers of such cases developed cases having specialized panels or pallets that carried the holders and pockets for the specific tools and were removable and replaceable within the case itself. Typically, such replaceable panels were held in place either with large snaps or other types of fasteners. While these approaches provided some additional benefits, they were not fully satisfactory. Snap connections between the panels and the carrying case might not be of sufficient strength to hold the panel when that panel carries a substantial quantity of tools. If the snaps were of sufficient strength, they were frequently very difficult to disengage for the purpose of replacing such a panel. An alternative structure used for connecting the panels to the interiors of the cases was that of a hook-and-loop fabric, such as VELCRO®, applied to the back of the panel and to the interior of the case. However, when new, such hook-and-loop material may have such a tenacious grip that it is very difficult to separate the removable panel from its engagement with the case. Later, that hook-and-loop material tends to lose its gripping qualities, so that the panels holding tools or components may come loose from the sides of the case and move around, causing damage to the tools and components.

SUMMARY OF THE INVENTION

In order to overcome the disadvantages of the prior apparatus, it is an object of the present invention to provide a carrying case with removable and replaceable interior panels that are securely retained but easily removed. In order to obtain this and other advantages that will become apparent to those skilled in the art, the carrying case of this invention has at least two opposable and generally rectangular side portions, with each side portion having two pairs of generally opposed edges, and there is provided a generally rigid, removable interior panel of generally rectangular shape with two pairs of generally opposed edges. At least one of the carrying case side portions has a channel portion fixedly positioned proximal one of the side portion edges, that channel portion having an open portion facing generally toward the side portion opposed edge and having a closed portion facing toward the one edge, whereby the channel portion may receive a portion of a first edge of the removable interior panel. The carrying case side portion also includes a resiliently biased, releasable retainer for resiliently and releasably engaging a second such edge of the interior panel to releasably hold that panel first edge in engagement with the channel portion.

FIRST DESCRIPTION OF THE DRAWINGS

One preferred embodiment of the carrying case of the present invention is illustrated in the attached drawings, in which.

DETAILED DESCRIPTION OF A PREFERRED EMBODIMENT

Figure 1:
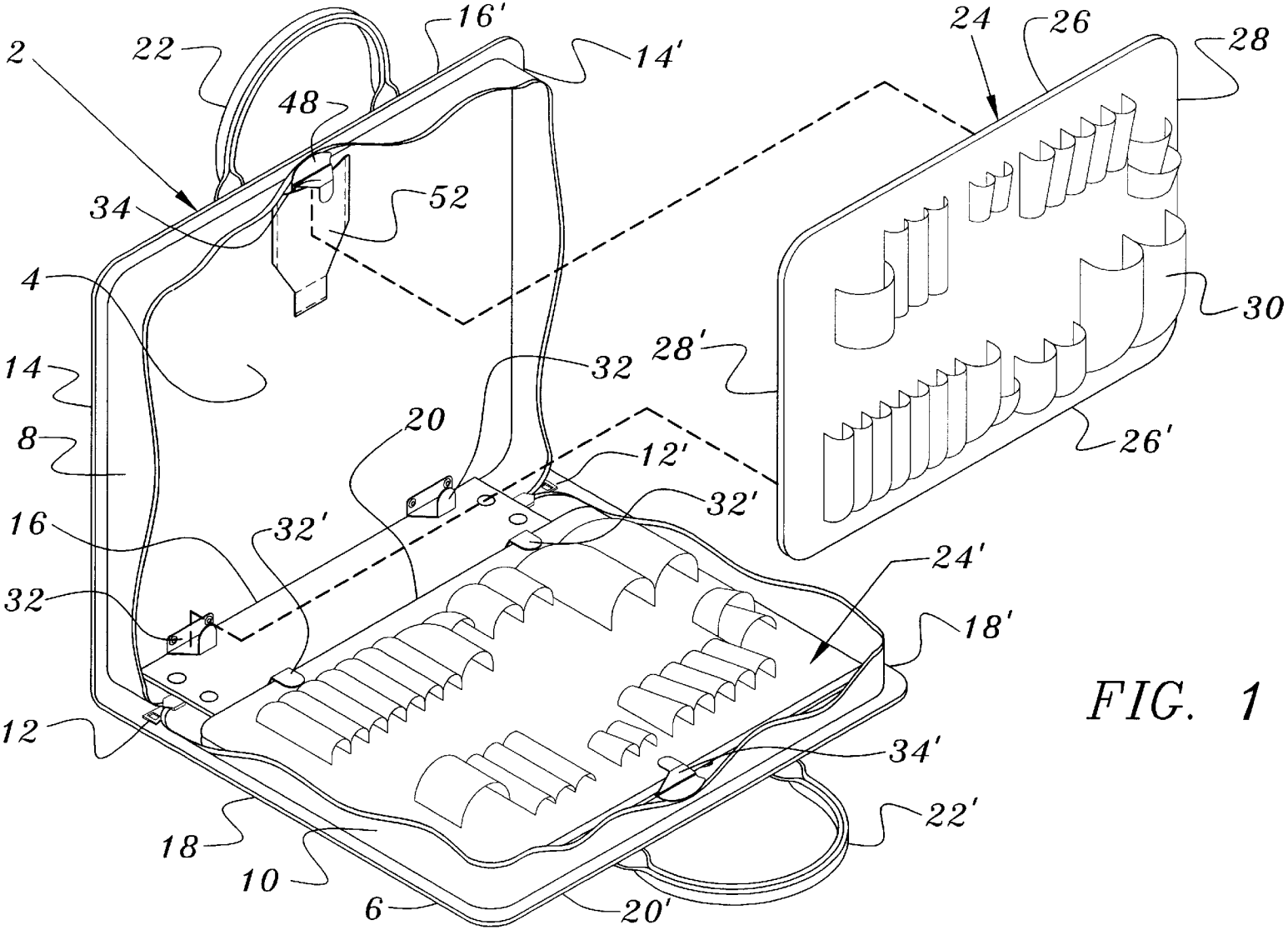
FIG. 1 is a perspective view of the case, in an open position, with one of the removable and replaceable interior panels spaced apart from its position of engagement with the case.

One preferred embodiment of the carrying case of the present invention is illustrated in the drawings of FIGS. 1 through 7. This carrying case, generally indicated by reference number 2, is, in its external configuration, generally conventional, having at least two opposable and generally rectangular side portions 4 and 6 with edge walls 8, and 10, respectively. These edge walls 8 and 10 may either be rigid or, as in the preferred embodiment, flexible, with a slide fastener 12 and 12' running along the outer extremities, to maintain the case in a closed configuration when the panel 6 is moved from the open position illustrated in FIG. 1, to a closed position generally parallel to panel 4. Of course, it is to be understood that a conventional hard sided case, such as an attache case, may be used with this invention with equal facility.

The side portion 4 in this embodiment has two pairs of generally opposed edges 14 and 14' and 16 and 16'. Likewise, side portion 6 also has two pairs of generally opposed edges 18 and 18' and 20 and 20'. Conventional carrying handle structures 22 and 22' are also provided for carrying the case. It is to be understood that the case may be fabricated from any conventional material, such as leather, vinyl, nylon, canvas or any of a range of other well-known materials conventionally used for such cases. Suitably, the side portions may be strengthened by the inclusion of rigid panels of plywood, fiberboard, metal, plastic or other well-known materials, although the carrying case of this invention will also function satisfactorily without such additional stiffening.

As an additional element of this invention, there is provided within the carrying case at least one generally rigid, removable interior panel, indicated by reference numeral 24, having a generally rectangular shape with two pairs of generally opposed edges 26 and 26' and 28 and 28'. This interior panel 24 may be fabricated of any suitable material that is generally rigid, which may conveniently include plywood, fiberboard, rigid plastics, metal or other materials. If desired, the removable panel 24 may be provided with pockets 30, or other suitable clips, straps, brackets or other means for holding tools and supplies to be used by a person carrying the case.

Figure 2:
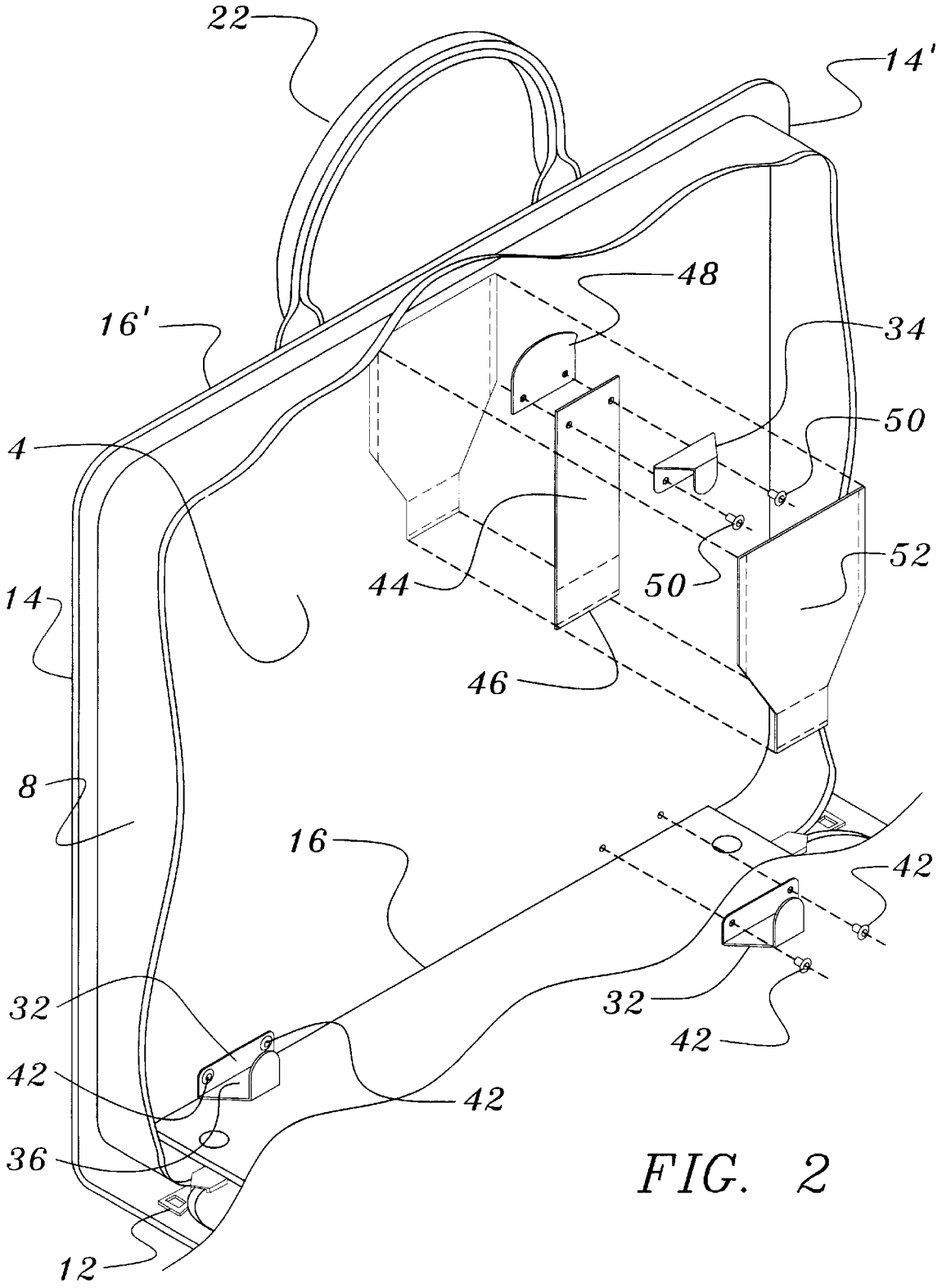
FIG. 2 is an exploded view of the components of one preferred embodiment of the interior panel retaining structure.
Figure 7:
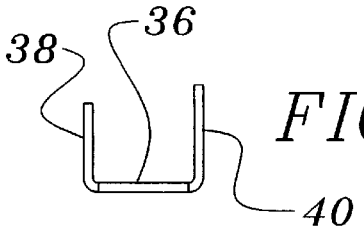

At least one of the carrying case side portions, such as portion 4, and preferably both such side portions 4 and 6, include structure for releasably holding the panel 24 (and 24') in position within the case. This releasable holding structure suitably includes one or more channel portions 32 for receiving a portion of a first edge of the removable panel 24 and a resiliently biased releasable retainer 34 for resiliently and releasably engaging a second edge of the interior panel 24. This channel structure and releasable retainer are shown in greater detail on the exploded view of FIG. 2 and on the details of FIGS. 3 through 7. While the channel portions 32 are shown as being a pair of relatively short pieces, it is to be understood that the invention would work equally well with a single such channel portion of suitable length. The channel portion 32 is suitably of a generally u-shaped cross sectional configuration, as shown in FIG. 7, having a base 36 with two leg portions 38 and 40 extending therefrom. This provides a channel member having an open portion facing away from that base 36. As shown in FIG. 2, the channel portion 32 is positioned proximal one edge 16 of the side portion 4, with the channel facing generally toward the opposed edge 16' of the side portion 4. Conveniently, each channel portion 32 is affixed to the side portion 4 of the case by conventional means, which suitably may be rivets 42.

Figure 3:
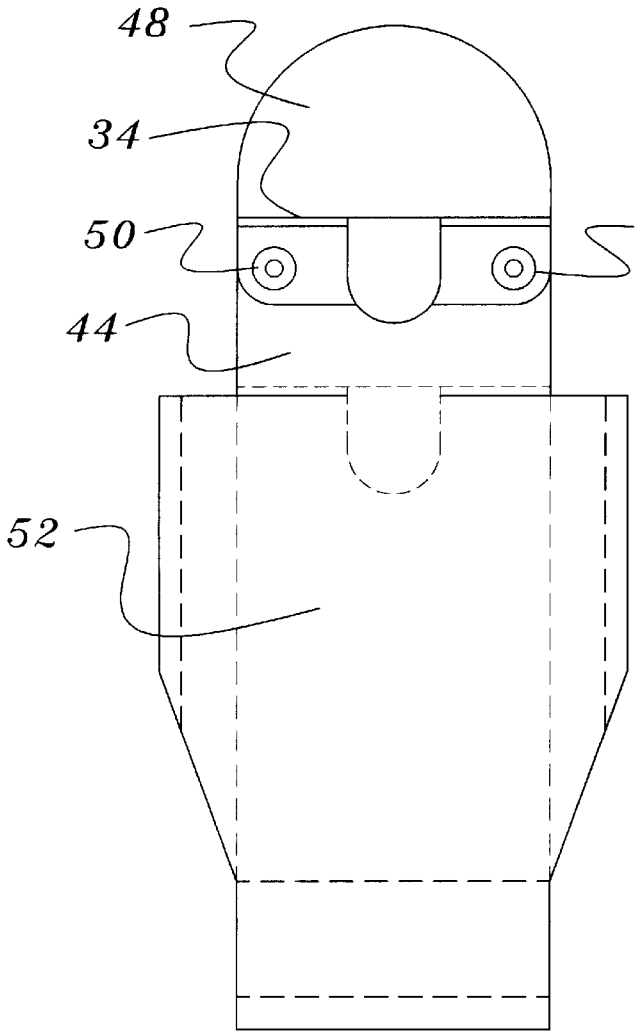
FIG. 3 is a plan view of the resiliently biased retaining hook assembly of FIG. 2.
Figure 4:
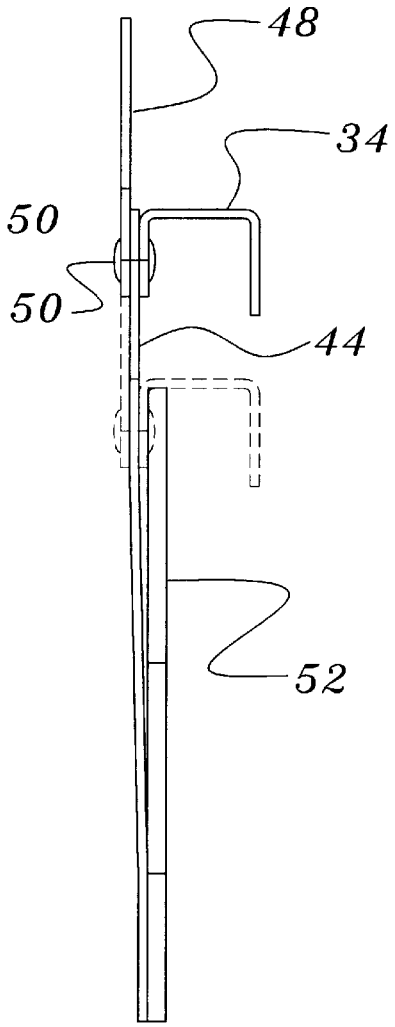
FIG. 4 is a side view of the assembly of FIG. 3.
Figure 5:
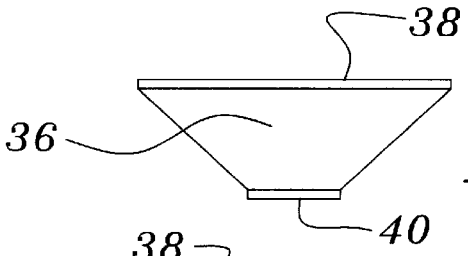
FIGS. 5 through 7 are three views of the retaining channel portion of the embodiment of FIG. 2.
Figure 6:
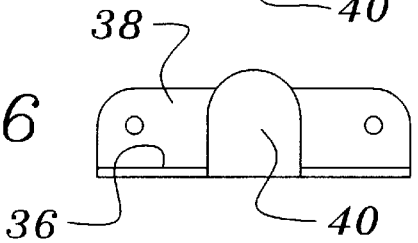

To releasably retain the removable interior panel in place within the channel portions, there is also provided a resiliently biased retainer. This retainer may conveniently be in the form of a hook-like structure such as another channel portion 34 attached to a resilient biasing element, which may conveniently be a strip of elastic material 44, or a suitable tension spring, or the like. As shown more clearly in the exploded view of FIG. 2, the u-shaped member 34 is attached with the open portion of the u-shaped member facing toward one side portion edge of the carrying case, suitably toward edge 16 of side portion 4. Conveniently, the u-shaped member 34 is of substantially the same configuration as the channel portions 32 and preferably is made from the same substantially rigid material, which may conveniently be either metal or a rigid synthetic resin. As shown in FIG. 2, one end 46 of the resilient biasing element 44 is preferably attached to the case side portion, suitably by adhesive bonding, sewing, riveting or other conventional means. The u-shaped element 34 preferably is attached to the end of the biasing element 44 opposite that end 46 that is attached to the case side portion. To make the use of this resilient retainer more convenient, a pull tab 48, which may be formed of leather, vinyl or other convenient material, may be attached to the same end of the resilient biasing member 44 as the u-shaped member 34. This tab 48 may conveniently be attached both to the resilient biasing element 44 and to the u-shaped member 34 by any conventional means, which conveniently be rivets 50. As shown in FIG. 1 and FIG. 3, this releasable retainer preferably is covered by a piece of suitable material, such as leather, vinyl, fabric or the like, indicated by reference number 52.

With the structure of the preferred embodiment of the carrying case of this invention having been described above, the manner of its use may now be seen, with particular reference to FIG. 1 of the drawings. In FIG. 1 there is illustrated associated with carrying case side portion 6 one of the removable and replaceable interior panels 24' installed, with two channel portions 32' receiving a portion of a first edge of that removable interior panel 24'. It should be noted that the replaceable panel 24' and its retaining structure associated with case side portion 6 may conveniently be substantially similar or identical to that associated with case side portion 4 and replaceable panel 24. That panel 24' is releasably retained in place by the resiliently biased releasable retainer 34', which is substantially identical in structure to that described above with respect to FIG. 2. Thus, the u-shaped member 34' resiliently urges a second edge of the interior panel 24' into engagement with the respective channel portions 32'.

As indicated by the dashed lines in FIG. 1, the removable interior panel 24 may be inserted and retained within the carrying case 2 by insertion of a first edge 26' of that panel into the channel portions 32, with the user then grasping the tab 48 and pulling it against the resilient biasing element in a direction away from the channel portions 32 to enable the second edge 26 of that removable panel 24 to be put in place against the inside of the case side portion 4, whereupon the tab 48 is released so that the resilient biasing element will urge the u-shaped portion 34 into engagement with that second edge 26 and thus retain that interior panel 24 in place, until the user decides to remove it by reversing the process.

While FIG. 1 illustrates a carrying case incorporating two removable and replaceable interior panels 24 and 24', it is to be understood that such a case may conveniently be used with only a single such panel, and also that cases may be fabricated with several compartments, so that they may use more than two such removable and replaceable panels. It is also to be understood that numerous variations and modifications of the structure of the preferred embodiment set forth above, all within the scope of this invention, will readily occur to those skilled in the art. Accordingly, this invention is to be limited solely by the claims appended hereto.

What is claimed is:

1. A carrying case with removable and replaceable interior panels, comprising said carrying case having at least two opposable and generally rectangular side portions, with each said side portion having two pairs of generally opposed edges;

at least one generally rigid, removable interior panel of generally rectangular shape with two pairs of generally opposed edges; and at least one of said carrying case side portions having a channel portion fixedly positioned proximal one of said side portion edges, said channel portion having an open portion facing generally toward said side portion opposed edge and having a closed portion facing toward said one edge, whereby the channel portion may receive a portion of a first edge of the removable interior panel; and a resiliently biased, releasable retainer for resiliently and releasably engaging a second said edge of said interior panel to releasably hold said panel first edge in engagement with said channel portion.

2. The carrying case of claim 1 further comprising a pair of said channel portions spaced apart from one another, whereby the two channel portions engage spaced portions of the first edge of the removable panel.

3. The carrying case of claim 1 wherein said channel portion is formed of a substantially rigid material.

4. The carrying case of claim 1 wherein said releasable retainer comprises a generally u-shaped member for engaging said interior panel second edge, with the open portion of said u-shaped member facing toward said one side portion edge of said carrying case, and a resilient biasing element connected both to said one side portion and to said member for urging said member in a direction toward said channel portion.

5. The carrying case of claim 4 further comprising a gripping tab extending outwardly from said u-shaped member, whereby a user may grip the tab and pull the member in a direction away from the channel portion to release engagement of the interior panel by the member and provide for removal of the panel from the case.

6. The carrying case of claim 4, wherein said u-shaped member is of substantially the same configuration as said channel portion.

7. The carrying case of claim 1, further comprising the provision of said channel portion and said releasable retainer on each of two said carrying case side portions, whereby two such removable interior panels may be received and retained within the case.

* * * * *